US006425567B2

(12) United States Patent
Schütze

(10) Patent No.: US 6,425,567 B2
(45) Date of Patent: Jul. 30, 2002

(54) BOOK HOLDING DEVICE

(76) Inventor: Christian Schütze, 10 Fichtenweg, Wolfratshausen D-82515 (DE)

( * ) Notice: Subject to any disclaimer, the term of this patent is extended or adjusted under 35 U.S.C. 154(b) by 0 days.

(21) Appl. No.: 09/769,198

(22) Filed: Jan. 24, 2001

(30) Foreign Application Priority Data

Jan. 28, 2000 (DE) ..... 100 03 787

(51) Int. Cl.[7] ..... A47B 97/04

(52) U.S. Cl. ..... 248/452; 248/454; 248/457; 108/6

(58) Field of Search ..... 248/452, 441.1, 248/446, 447, 451, 454, 460; 108/2, 6, 8, 9, 27; D6/419

(56) References Cited

U.S. PATENT DOCUMENTS

| | | | | | |
|---|---|---|---|---|---|
| 1,343,229 | A | | 6/1920 | Philbrook, Jr. | |
| 1,645,769 | A | * | 10/1927 | Murray | 108/9 |
| 1,652,774 | A | | 12/1927 | Fraser et al. | |
| 1,691,191 | A | * | 11/1928 | Henderson | 108/8 |
| 1,713,376 | A | | 5/1929 | Durig | |
| 2,006,580 | A | * | 7/1935 | Broun | 248/454 |
| 2,741,868 | A | | 4/1956 | Saunders | |
| 3,641,946 | A | * | 2/1972 | Charnay | 108/6 |
| 3,682,109 | A | * | 8/1972 | Gordon | 108/9 |
| 4,022,418 | A | * | 5/1977 | Kellner | 248/460 |
| 4,108,083 | A | | 8/1978 | Espinosa | 108/6 |
| 4,163,539 | A | | 8/1979 | Awofolu | 248/452 |
| 4,372,631 | A | * | 2/1983 | Leon | 312/231 |
| 4,383,486 | A | | 5/1983 | Reineman et al. | 108/2 |
| 4,466,593 | A | | 8/1984 | Odenath | 248/455 |
| 4,512,603 | A | * | 4/1985 | Williams | 294/137 |
| 4,548,391 | A | * | 10/1985 | Loban | 269/47 |
| D293,397 | S | * | 12/1987 | Hunt | D6/429 |
| 4,943,040 | A | * | 7/1990 | Finstad et al. | 269/69 |
| D341,958 | S | * | 12/1993 | Allred | D6/406.4 |
| 5,484,124 | A | * | 1/1996 | Billings | 248/118 |
| 5,601,036 | A | * | 2/1997 | Kieser et al. | 108/107 |

FOREIGN PATENT DOCUMENTS

| | | |
|---|---|---|
| DE | 80 00 787 U1 | 4/1980 |
| DE | 43 21 283 | 1/1995 |
| DE | 297 15 923 | 1/1998 |
| DE | 197 48 793 | 8/1999 |

* cited by examiner

*Primary Examiner*—Anita King
(74) *Attorney, Agent, or Firm*—Nields & Lemack

(57) ABSTRACT

A device for holding reading or writing material or a laptop in a laying or seated position includes two board-like, trapezoidal side panels [112, 114] made of wood product, a cross-beam [16, 115] made of wood product holding the side panels together and preventing one panel moving with respect to the other, a support plate [20, 120] made of plywood, the position of which can be adjusted in relation to the side panels, and a device [22, 24; 122, 124] for setting the different positions of the support plate in relation to the side panels one of which contains a row of holes [24, 124] into which a pin [22, 122] can be inserted to hold the support plate in the desired position whereby insertion of the pin (122) in a hole [124*a*] and the stopper [127] allow for the support plate to be horizontally positioned.

10 Claims, 3 Drawing Sheets

BOOK HOLDING DEVICE

The present invention relates to a device for holding a book, periodical and similar material ("reading or writing matter") or a laptop while reading or writing, e.g. in bed or in an easy or garden chair. This device will hereafter be referred to simply as the book holder.

BACKGROUND OF THE INVENTION

Devices of this type are known in a variety of designs. However, no book holder is currently available which is produced using environmentally sustainable methods and materials, i.e. made of renewable primary materials, especially wood material, which can be produced simply and economically and which can be recycled without adverse environmental impact:

SUMMARY OF THE INVENTION

A primary object of the present invention is to provide a book holder that meets the above objectives.

According to the invention, an embodiment of the holding device, i.e. a device for holding a book or another object, comprises two flat side panels, a cross beam which holds the side panels together and prevents one from moving or rotating in relation to the other, an adjustable plate serving as a table or support between the side panels and a device for setting this plate in a variety of angled positions in relation to the side panels. Side panels, cross beam and plate are made according to the invention from wood material.

Preferred embodiments comprise further means for holding down the pages of a book laid on the plate.

A feature of the present book holder is its uncomplicated construction. It is light and is easy to manipulate. It is simple, energy saving and economical to produce and can be recycled without adverse environmental impact since it consists essentially of wood products (wood materials). It makes reading easier especially for older people, patients and children. A most preferred embodiment is designed as a prefabricated kit for user assembly. This operation can be carried out with a simple screwdriver.

Embodiments of the invention are described with reference to the accompanying drawings in greater detail below.

SHORT DESCRIPTION OF THE DRAWINGS

DETAILED DESCRIPTION

Figure 1:
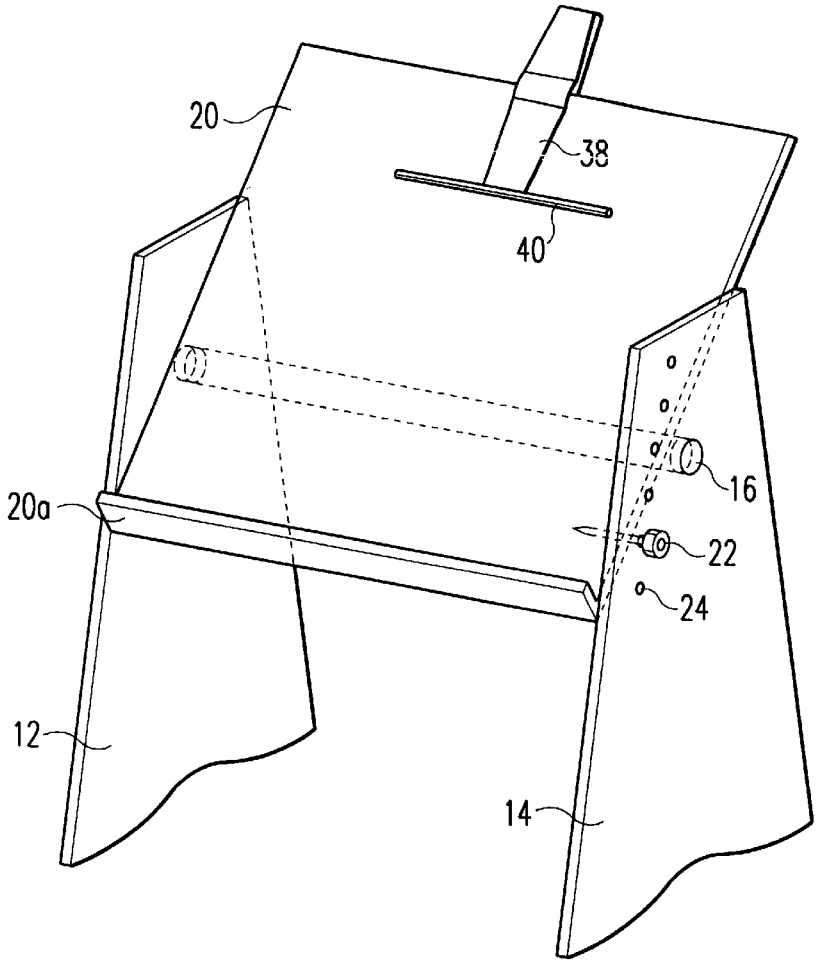
FIG. 1 is an isometric view of a first embodiment of the book holder according to the invention.
Figure 2:
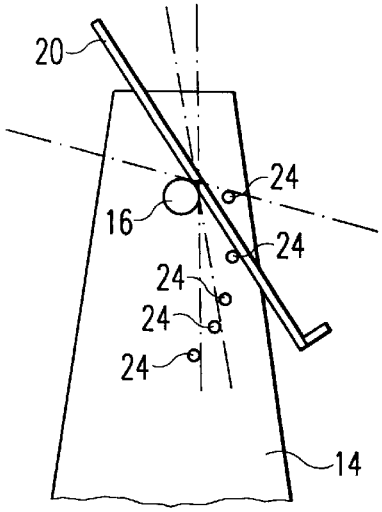
FIG. 2 is a partial view of the side panel 14 of the book holder according to Fig l(as seen from side panel 12)
Figure 3:
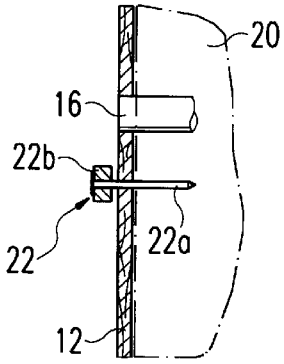
FIG. 3 is a side view of a stopping device of the book holder of FIG. 1.

The book holder shown in FIG. 1 comprises two parallel, flat, board-like side panels 12, 14 made of wood products, in particular untreated natural wood or laminated wood. Essentially they have a tall, slender trapezoidal shape and are connected by a single round wooden cross-beam 16 which is glued into corresponding recesses in the side panels 12, 14. Two metal loops or clips 18 (FIG. 4) fixed to a support plate 20 allow rotation of this plate around the crossbeam 16 between the side panels 12, 14. The support plate is preferably made of plywood. On its lower margin the support plate 20 has a protruding rim 20*a*, which prevents slippage of an object placed on the plate. A pin 22 (FIGS. 1 and 3) is used for maintaining the plate 20 in any of several different adjustable positions 24 (FIGS. 1 and 2). It is inserted into one of a number of matching holes 24 provided for this purpose in one of the side panels (in Fig.1 it is side panel 14). In this embodiment the pin 22 consists of a nail 22*a* to which a round wooden plug 22*b* has been fitted as a grip, as shown in FIG. 3.

Figure 4:
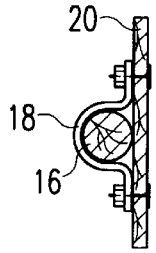
FIG. 4 is a side view of a device for rotably positioning of a support plate on a cross beam of the book holder of FIG. 1.
Figure 5:
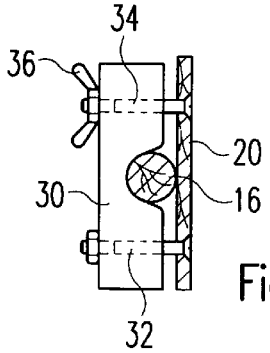
FIG. 5 is an alternative device for rotably mounting the support plate.

FIG. 5 shows an alternative to the metal clips 18 as shown in FIG. 4. In this variant two recessed wooden blocks 30 fixed to the support plate 20 by bolts 32, 34 allow rotation of the plate 20 around the cross-beam 16. One bolt has a normal hexagonal nut, the other a butterfly nut 36 by means of which the tightness of the wooden block 30 (or, analogously, of the clip 18 in FIG. 4) can be varied.

A peg or clamp 38 is used for holding flat a book placed on the plate 20. The front arm of the clamp 38 is fitted with a cross-bar 40.

Figure 6:
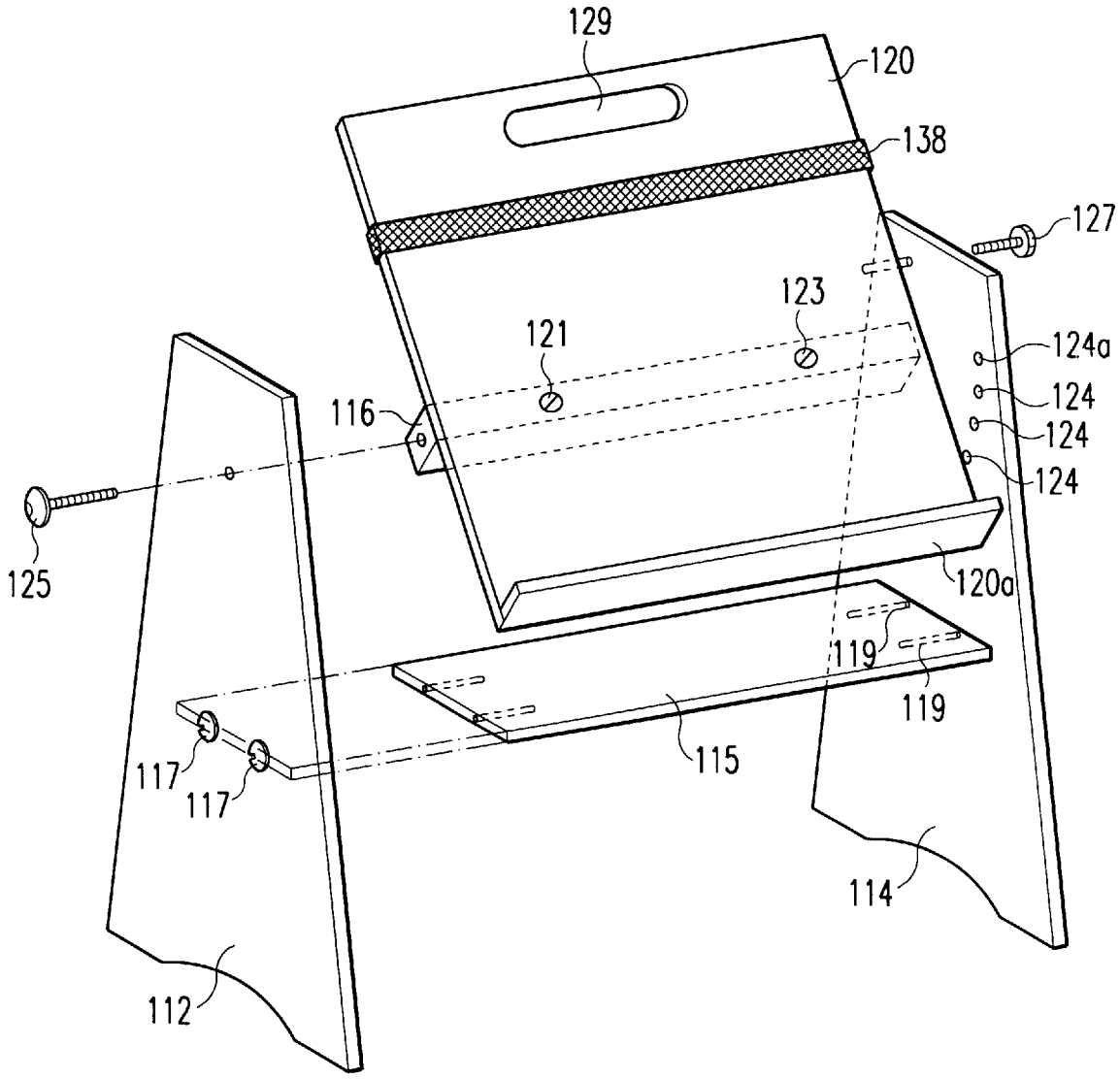
FIG. 6 is an isometric, exploded representation of a second embodiment of the invention (the one currently preferred)
Figure 7:
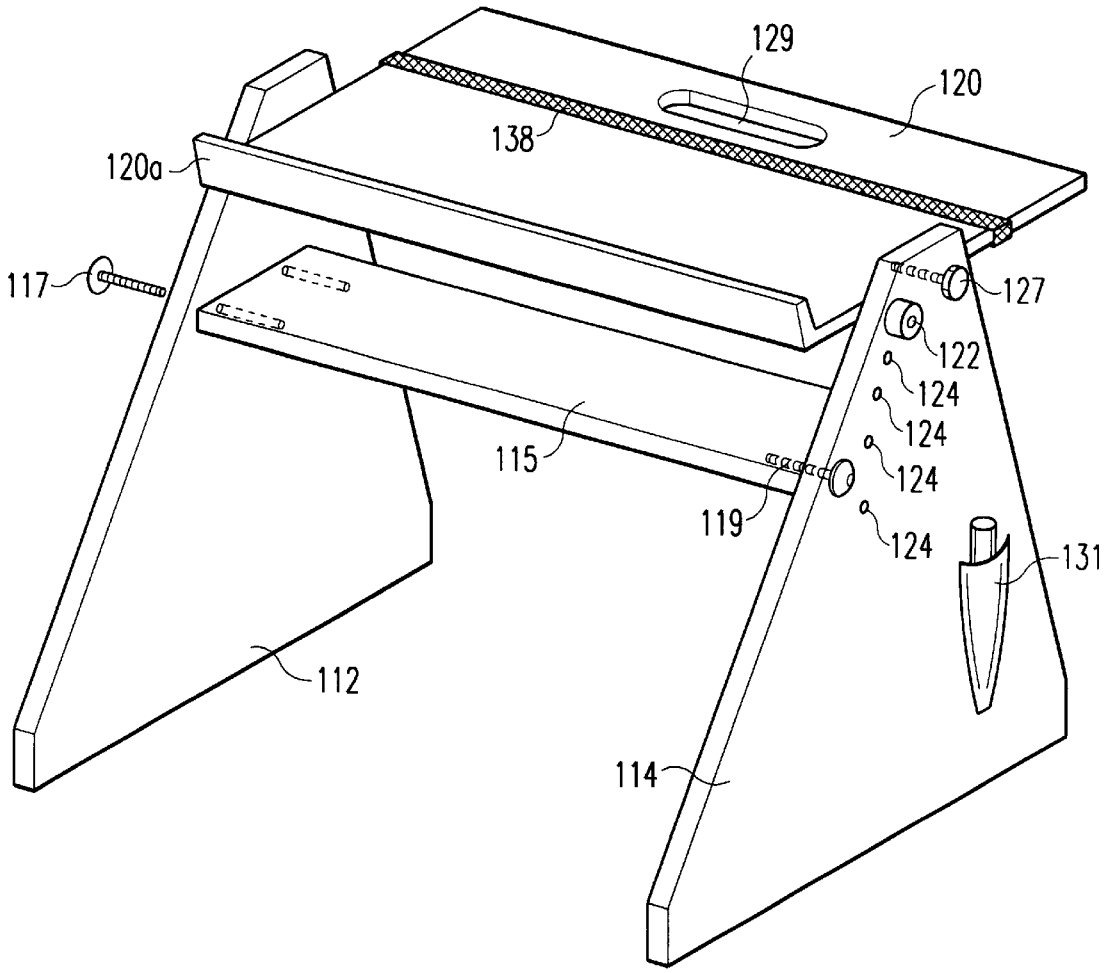
FIG. 7 is a perspective view of the book holder of FIG. 6 with the support plate in the horizontal position.

The embodiment shown FIGS. 6 and 7 is preferred at present. It basically corresponds to the book holder described above with reference to FIG. 1. Reference numbers for corresponding items are the same plus 100.

As shown in FIG. 6, the board-like side panels 112, 114 are connected by means of a board-like crossbeam 115 attached to the side panels on each side by two screws 117, 119. In this embodiment the side panels 112, 114 run parallel as per FIG. 1, and are also trapezoidal or triangular in shape.

A bar 116 of square cross-section is fixed to the back of the support plate 120 by means of two drop-headed screws 121, 123. The bar 116 (and consequently the support plate 120) is rotably mounted between the side panels using two drop-headed screws 125, of which only one screw is shown. The screws (125) serve as shaft butts and rotate in corresponding holes in the side panels.

The support plate 120 can also be used as a table, if it is positioned horizontally (FIG. 7). It then rests on a stopper consisting of a screw 127 (FIGS. 6 and 7). In this position the plate 120 is held secure by the pin 122, which is inserted into a corresponding upper hole 124a (FIG. 6) in the display of holes 124.

The plate 120 is provided with an elongated grip hole 129 so that the book holder can be picked up and transported easily. In FIGS. 6 and 7 a ring-shaped rubber band 138 is used to hold down the pages of a book (not shown) laid on the plate; the band can be shifted depending on the size of the book.

As shown in FIG. 7, a pouch 131 is fitted to the side panel 114 in order to hold a pencil or a ball pen. To prevent the pin 22, 122 from getting lost, it is fastened with a small thread or chain to the side panel.

Advantageously, the book holder shown in FIGS. 6 and 7 can be delivered in separate pieces shown in FIG. 6 as a prefabricated kit. Only a screwdriver is required for complete assembly.

The side panels, the support plate the cross beam 115 and the bar 116 are made of wood materials, e.g. the plate 120 of plywood and the other wood material items of natural wood.

The grip hole, pencil pouch and stopper for retaining the plate in the horizontal position can also be added to the embodiment of FIG. 1.

What is claimed is:

1. A holding device comprising a) a pair of board-shaped flat side panels (12, 14; 112, 114) made of wood material;

b) cross-beam means (16, 116) for holding the side panels together and at the same time preventing one from rotating in relation to the other, c) a support plate (20, 120), made of wood material, d) means (16, 18; 116, 125) for rotably mounting the support plate relative to the side panels, e) means (22, 24; 122, 124) for setting several different angular positions of the support plate in relation to the side panels, said setting means comprising a row of holes (24, 124) in one of said side panels and a pin (22, 122) adapted to be inserted into any desired of said holes to act as a stop determining the angular position of said support plate.

2. The device as claimed in claim 1, wherein the cross-beam means (16) comprises a rod to which the support plate (20) is rotably mounted.

3. The device as claimed in claim 1, wherein the cross-beam (115) is a board-shaped member.

4. The device as claimed in claim 1, wherein the means for rotably mounting the support plate (120) comprises two screws (125) serving as shaft butts.

5. The device as claimed in claim 4, wherein the screws (125) are sunk in a ledge (116) fixed to the support plate (120).

6. The device as claimed in claim 1, wherein the side panels (12, 14; 112, 114) at least in their upper parts have a trapezoidal shape.

7. The device as claimed in claim 1, comprising means (38, 40; 138) for holding down the pages of reading material positioned on the support plate.

8. The device as claimed in claim 7, wherein the holding down means comprises a rubber band (138).

9. The device as claimed in claim 1, wherein the plate (120) is fitted with a grip hole (129).

10. The device as claimed in claim 1, wherein the support plate (120) is comprises of plywood.

* * * * *